US006993863B2

(12) United States Patent
Baboz

(10) Patent No.: US 6,993,863 B2
(45) Date of Patent: Feb. 7, 2006

(54) TRANSFER DEVICE FOR AN INDUSTRIAL FLATWORK IRONER

(75) Inventor: Nicolas Baboz, Gresy sur Aix (FR)

(73) Assignee: Societe Jean Michel, (FR)

( * ) Notice: Subject to any disclaimer, the term of this patent is extended or adjusted under 35 U.S.C. 154(b) by 316 days.

(21) Appl. No.: 10/311,578

(22) PCT Filed: Jun. 15, 2001

(86) PCT No.: PCT/FR01/01882

§ 371 (c)(1),
(2), (4) Date: Aug. 11, 2003

(87) PCT Pub. No.: WO01/96650

PCT Pub. Date: Dec. 20, 2001

(65) Prior Publication Data

US 2004/0124580 A1 Jul. 1, 2004

(30) Foreign Application Priority Data

Jun. 16, 2000 (FR) ..... 00 07736

(51) Int. Cl.
*D06F 67/04* (2006.01)

(52) U.S. Cl. ..... 38/143

(58) Field of Classification Search ..... 38/143; 198/803.5, 468.2, 468.4, 471.1; 271/3.18, 271/3.24, 900, 205; 414/618, 620, 621
See application file for complete search history.

(56) References Cited

U.S. PATENT DOCUMENTS

| | | | | |
|---|---|---|---|---|
| 3,736,678 | A * | 6/1973 | Kamberg | 38/143 |
| 3,772,808 | A * | 11/1973 | Behn | 38/143 |
| 5,600,906 | A * | 2/1997 | Hamid | 38/143 |
| 5,815,963 | A * | 10/1998 | Rauch et al. | 38/143 |
| 6,477,797 | B1 * | 11/2002 | Takahashi et al. | 38/143 |
| 6,826,856 | B1 * | 12/2004 | McCabe | 38/143 |

FOREIGN PATENT DOCUMENTS

| | | |
|---|---|---|
| DE | 19650982 | 6/1998 |
| EP | 0345087 | 12/1989 |
| EP | 0424290 | 4/1991 |
| EP | 0567046 | 10/1993 |
| JP | 11140769 | 5/1999 |

* cited by examiner

*Primary Examiner*—Ismael Izaguirre
(74) *Attorney, Agent, or Firm*—Cantor Colburn LLP

(57) ABSTRACT

The invention concerns a transfer device between a conveyor supplying articles and a second conveyor whereon the articles are spread out, the transfer means including, between the supply conveyor and the second conveyor, a vertical passage wherein each article is successively brought in vertical position and clamps, and means for gripping the article including a slider provided with suction means. The device includes, opposite the means gripping the article, a fixed stop located on a same side of the vertical plane of the article as the supply conveyor, and against which the gripping means are urged to be supported during the phases opening of the clamps and transferring the upper end of the article onto the gripping means.

6 Claims, 5 Drawing Sheets

TRANSFER DEVICE FOR AN INDUSTRIAL FLATWORK IRONER

TECHNICAL FIELD OF INVENTION

The present invention provides a transfer device for an industrial flatwork ironer designated as "short edge feeding".

Such a machine is used to stretch flat a square or rectangular article such as a cloth, a draw sheet, a napkin or the like, with a view toward subsequent processing of this article. This subsequent processing is in particular passing the article in an ironing machine then into a folding machine.

The invention concerns more particularly where the cloths are introduced on the short edge without prior search for the corners of the piece.

DESCRIPTION OF RELATED ART

A known "short edge feeder" is represented in reference to FIGS. 1 to 4. This feeder includes:

From one to four feeding stations 4;

An unpacking table 2 and a means of transfer by stations 14;

A passageway 5 and the article in it;

A grasping and 90° transfer apparatus, 16;

Two movable trolleys 7, 9 along this guide beam, quipped with clamps suit or grasping two corners to the article;

A guide beam 6 perpendicular to the direction of feed of the article in this passageway;

A photoelectric cell 11 placed at the level of the median zone of this passageway below it;

Equipment for moving the trolleys along the guide beam and

Equipment for controlling this movement;

A means or grasping the edge of the article 12 perpendicular to the direction of feed of the article in the passageway 5, propelled by a back and forth motion which permits grasping the article in the front and rear position, which permits depositing the article on A conveyor 13 which permits placing the article on the passageway 5.

The current workstations of these machines are comprised by a non-motorized band conveyor 1 supported by its own weight on a motorized band conveyor 2. The conveyor 1 is articulated at the rear such that such that the operator can retract it in order to recover the article which he/she has improperly introduced.

The operator grasps the piece of linen, locates the short edge of this piece of linen and introduces in between conveyor 1 and conveyor 2.

The piece of linen is held between the two conveyors by the exertion of pressure by the weight of conveyor 1.

In the event that the stations are opposite one another, there exist two solutions:

When one station transfers a piece of linen, the other is in expectation and the operator expects to be able to introduce his/her piece of linen.

To permit the operator to introduce his/her piece of linen even if the piece of tie opposite station is still in the process of treatment, one motorized band conveyor 3 is added per workstation.

In the last case, the operator can introduce the product between conveyors 1 and 3 in the event that conveyor 2 is not free. This permits him/her to prepare the following article.

When the cell for detecting the presence of the piece is masked by the piece of linen introduced, the conveyor 2 starts up, the piece of linen is spread out to be transferred by the transfer means 14. The transfer is made perpendicular to the direction of spread of conveyor 2 and on conveyor 15. The piece is subsequently grasped and transferred by means 16 as shown in FIG. 4. This means 16 transfers the article from its horizontal position into a vertical position in which the article is in fee fall on its part situated above means of transfer 16. The transfer apparatus 16 is comprised by a motorized roller 23 and two small rollers 24 and 25 rotating freely placed on the motorized roller 23 and brought into motion by friction on this sane roller 23.

Once the article is grasped by means 16, the cross-wise movable trolleys 7 and 9, equipped respectively with the clamps 8 and 10, run counter to the article and follow it in its fall without ever disturbing the movement of the article thanks to detection apparatus 17, 18, 19 mounted on trolley 7 and apparatus 20, 21, 22 mounted on trolley 9.

The control units of trolleys 7 and 9 are comprised by:

An electronic control system linked to a unit including a variator and a positioning card driving One gear motor group per trolley each equipped we an impulse coder;

One drive pulley per trolley integral with the frame of the machine;

One return pulley per trolley integral with the frame of the machine;

One toothed transmission belt per trolley arranged between the drive and the return pulleys.

Trolley 7 and trolley 8 are linked to their transmission by a fixation device.

When the end of the article is transferred from conveyor 15 toward apparatus 16, the detection unit mounted on the trolley 7 is released providing notification of the end of the piece for the edge of the article situated on the edge of trolley 7 in relation to the axis of passageway 5. In symmetry and in an interval of time prior and subsequent to the preceding action, and when the end of the article is transferred from the conveyor 15 toward apparatus 16, the detection unit 27 mounted on the trolley 9 is released, providing information on the end of the piece for the edge of the article situated on the edge of trolley 9 in relation to the axis of passageway 5.

The detection units 26 and 27, respectively, provide information on the completion of the passage of the article for the left part of the article and the right part of the article, respectively, in relation to the direction of advance of the article in the passageway 5. This information permits triggering closing of the clamp 8 and the clamp 10 mounted on trolley 7 and trolley 9. The notice of closing associated with a delay adjustable by the electronic control system permits optimizing the grasp so that clamp 8 and the clamp 10 grasp the article by its rear corner. Grasping the rear corners permits correcting defects in orientation of the piece of linen in relation to the grasping apparatus 12. This correction is indispensable for guaranteeing a good quality of processing by drying, folding and stacking which will be applied to the piece later on.

The piece of linen grasped by the clamps 8 and 10 is subsequently held and centered in relation to the axis of the passageway 5.

In the lower part an apparatus 29 designed to smooth the piece out can be used to improve the quality of the deposit of the pieces. This apparats can be comprised by rowing brushes associated with a box where the piece of linen is drawn in by a system of aspiration of air.

The grasping apparatus 12 comprised by a rod extending over the entire breadth of the machine and which is situated in a waiting position, is activated toward the front then stopped in a position where the front part of the grasping apparatus 12 is tangent to the piece.

The two actions which follow consist in opening the clamps 8 and 10 and transferring the piece by the transfer apparatus 28. This transfer apparatus can, for example, be comprised by a tube closed as its extremities including a series of small-sized orifices spaced at regular intervals over the entire length of the tube and situated on a generator of the tube located alongside the piece to be transferred and having a compressed air feed. The transfer is brought about by injecting compressed air for a short duration into the tube of the transfer apparatus 28 and by the intermediary of an electric valve. By escaping through the orifices executed on the generator of the tube, the air rapidly propels the piece in a direction adjustable by the orientation of the tube.

These two actions associated with a delay adjustable by the electronic control system allow optimizing the transfer. The piece falls toward the grasping apparatus 12 which contains an air aspiration device and orifices arranged in a manner to keep the piece firmly placed over its entire length.

The grasping apparatus 12 which is situated in the front position is activated toward the rear. The grasping apparatus 12 places the piece and spreads it on the conveyor 13.

The air aspiration device with which the grasping apparatus 12 is equipped is deactivated before the finish of the course of the grasping apparatus 12 to release the piece and deposit it on conveyor 13. Conveyor 13 star and carries the piece up to the following treatment.

Such a device has several inconveniences:

The falling article can be aspirated by the smoothing apparatus which is acting upon the piece preceding the falling piece. To avoid this dysfunction, the spacing between the pieces is increased to the detriment of the pace of production.

The piece of linen can descend according to its size, state and its weight during the transfer onto the grasping apparatus 12 at the moment the clamps 8 and 10 open. This fall can entail a blockage of the transfer and in this case, the piece is lost. This drop, which takes place after having corrected the orientation of the piece by taking the corners into the clamps 8 and 10, also entails deficiencies in orientation which considerably reduce the quality of the following treatments: drying, folding and stacking.

When the piece has been transferred on the grasping apparatus and the transfer apparatus 12, the corners of the piece are knocked upward or downward due to the blowing which is applied near the corners. At this site, the blowing of the transfer apparatus 28 has a tendency to cause the advance of the corners in relation to the rest of the piece. This advance entails rebounds and imprecisions in positioning the corners in relation to the rest of the piece at the moment of contact of the piece with the grasping apparatus 12. These imprecisions translate into one or two corners being folded down or even folds near the corners.

BRIEF SUMMARY OF THE INVENTION

The invention provides a device which permits increasing the pace of function of the machine while reducing the distance between two successive pieces. The invention avoids the pieces which are transferred having beaten down corners, and that they are thus perfectly flat.

For this reason, the device to which it relates has a conveyor for supplying the pieces and a second conveyor on which the pieces are spread, transport devices including a vertical passageway between the supply conveyor and the second conveyor in which each piece is successively brought into vertical position and grasped by its two angles situated downstream in relation to the direction of motion by two movable clamps on a beam oriented cross-wise in relation to the conveyors, a blowing ramp situated alongside the conveyor in relation to the vertical plane in which the piece of fabric is located and the nozzles of which are oriented toward the conveyor, an apparatus for grasping the piece, for example in the from of a rectangle equipped with aspiration devices situated on one side the conveyor and above it, movable longitudinally on the conveyor between an advanced position of grasping the piece of textile and a retracted position of depositing the piece on the conveyor, characterized in that it contains, facing the apparats for grasping the piece, a fixed abutment situated on the same side of the vertical plane of the pieces the supply conveyor, and against which the grasping apparatus is supported during the phases of opening the clamps and transfer of the upper extremity of the piece on the grasping apparatus.

Advantageously, the fixed abutment is covered by a band of elastic material in the zone of support of the grasping apparatus. The piece of fabric is thus sandwiched between the grasping apparatus and the mechanical abutment which eliminates the risks of falling to the extent that this sandwiching is firmly maintained during the transfer. The band of elastic material permits compensating for defects in pitch and in particular alignment between the grasping apparatus and the abutment. The piece held thus can be transferred in good condition and without disturbing the corrections of defects in orientation of the piece in relation to the grasping apparatus previously realized by the clamps taking the corners of the piece.

According to another characteristic of the invention, each prehensile clamp of an angle of the piece of textile or the support of each clamp is equipped with a deflector designed to deflect the flow of air blown by the nozzles of the ramp arranged in the zones of the piece near the angles thereof to avoid these zones being subject to the flow of compressed air.

The deflectors thus prevent the zones near the corners of the piece being bent or the pieces being folded in the zones during the transfer on the exit conveyor.

According to another characteristic of this device, to the extent that it has a smoothing out system arranged below the conveyor which exerts an under-pressure, the latter is equipped with devices designed to avoid a piece coming from the supply conveyor and arriving in the vertical passage way being aspirated into the smoothing out system.

In accordance with an embodiment, this device includes a tube fed by air under pressure situated on the same side of the passageway as the supply conveyor and, facing the entrance of the soothing system, has orifices distributed radially on the length of the the opening on the side of the tube where the piece should be attracted, that is an the side opposite to the smoothing out system.

These devices permit removing the piece falling vertically from the smoothing out system. The flow of air exiting from the tube creates an under-pressure attracting the piece of fabric in the direction opposite to the smoothing out device. In order to reinforce this deflecting effect while accentuating the Venturi effect, and in order to avoid disturbing the behavior of the pieces situated downstream in the transfer cycle, a fixed wall forming a deflector is arranged facing the orifices arranged in the tube.

BRIEF DESCRIPTION OF THE DRAWINGS

In any case, the invention will be better understood with the aid of the description which follows in reference to the appended schematic drawings representing an embodiment of this industrial flatwork ironer by way of non-limiting example.

DETAILED DESCRIPTION OF THE INVENTION

Figure 2:
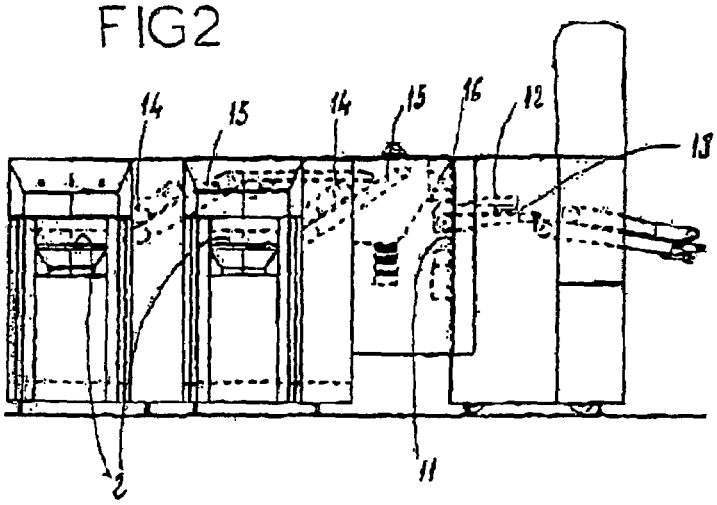
FIG. 2 is an elevation.
Figure 3:
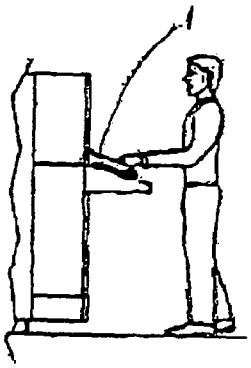
FIG. 3 is a detailed view of a feeding station.
Figure 1:
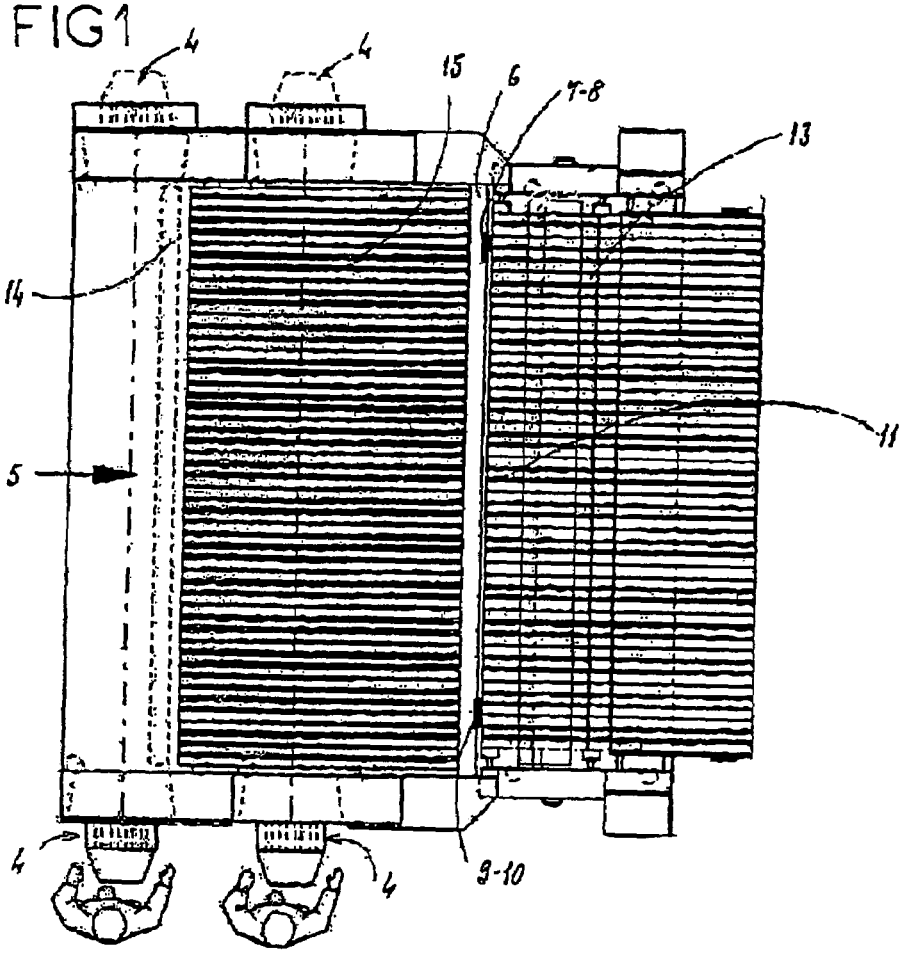
FIG. 1 is a plan view.
Figure 4:
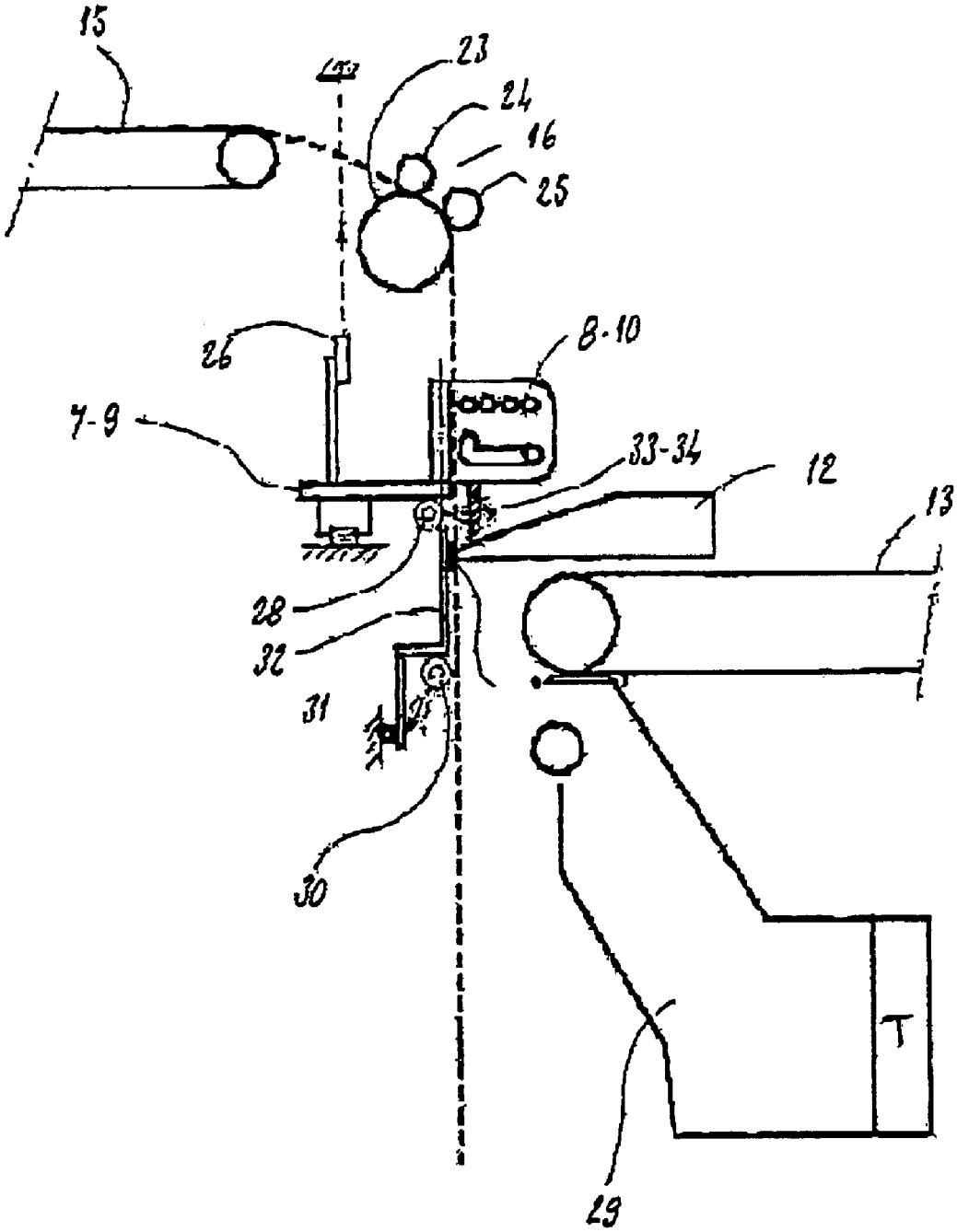
FIG. 4 is an elevation on enlarged scale of the transfer station between a first supply conveyor and a second conveyor.
Figure 5:
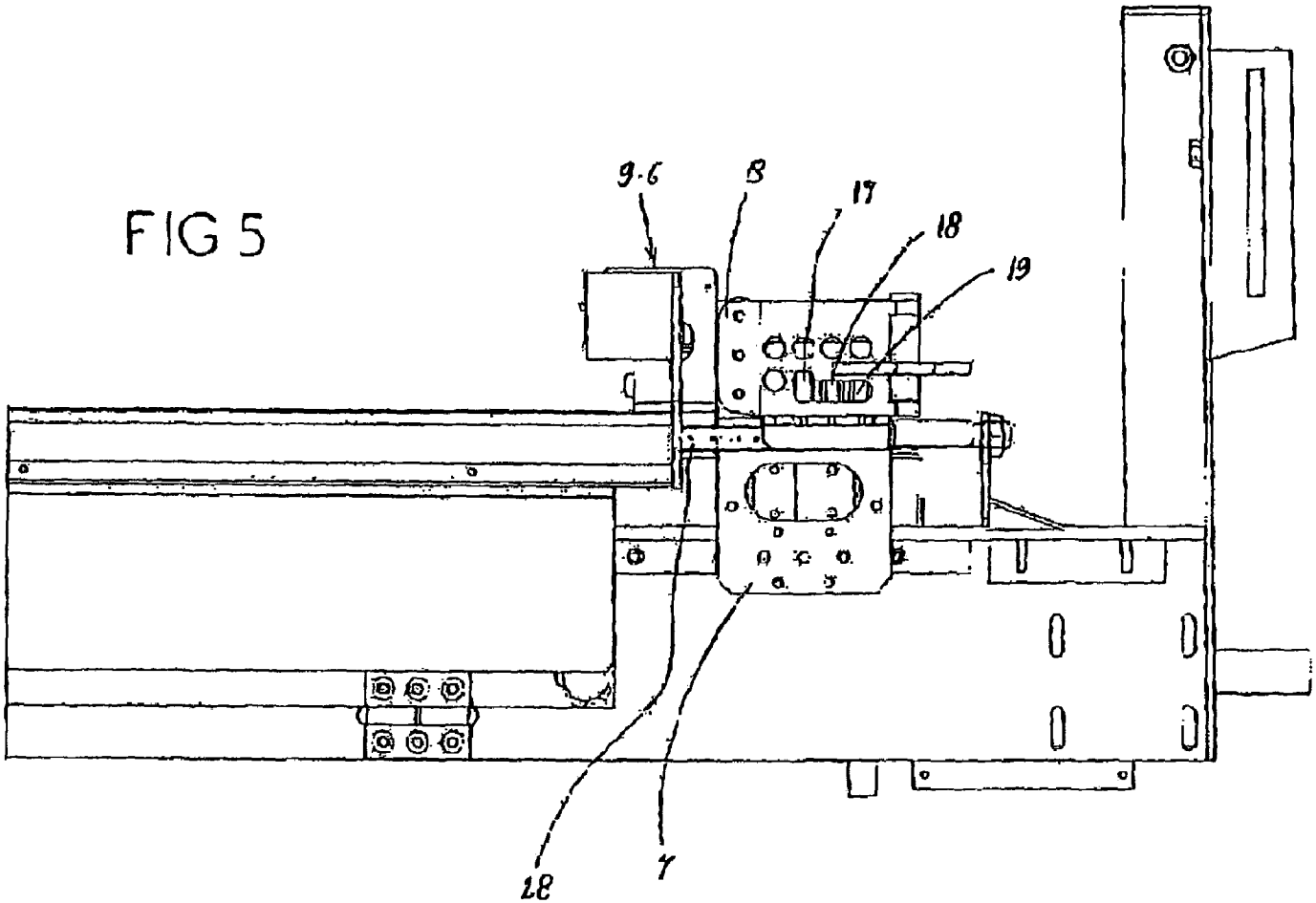
FIG. 5 is a front view of an extremity of the transfer device.
Figure 6:
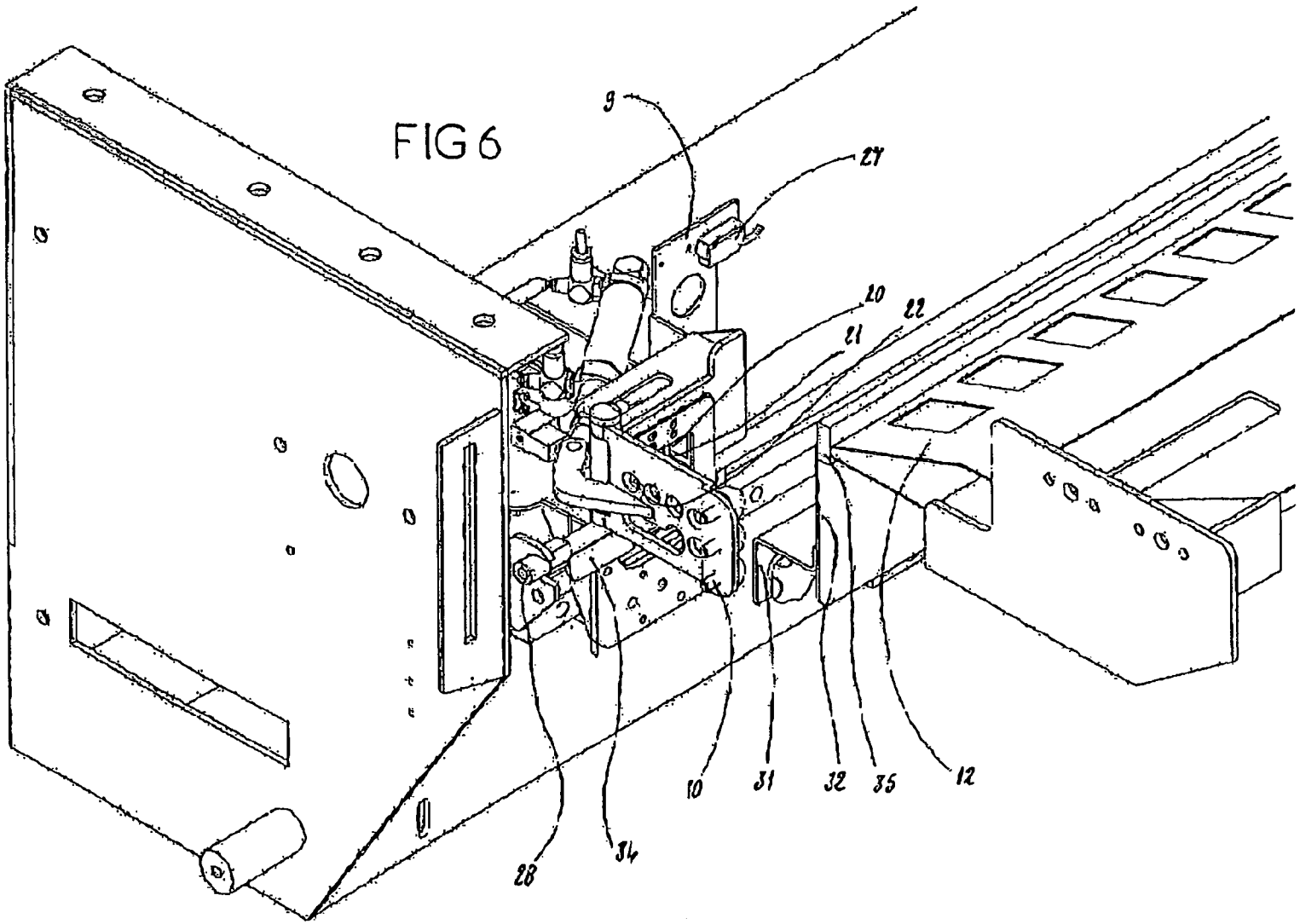
FIG. 6 is a perspective view of an extremity of the transfer device.
Figure 7:
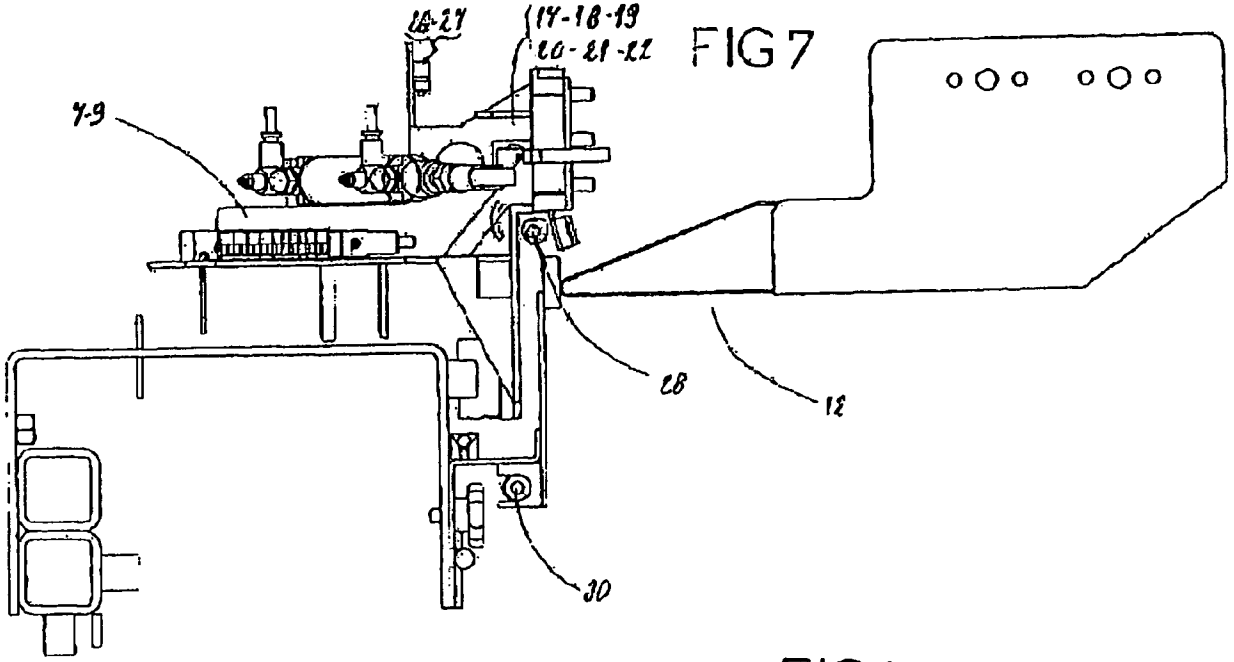
FIG. 7 is an elevation similar to FIG. 2.
Figure 8:
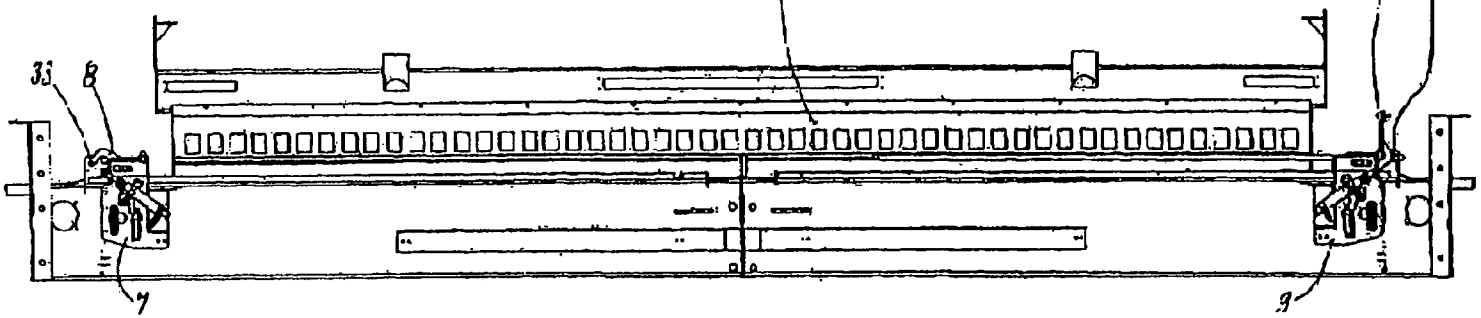
FIG. 8 is a plan view of the transfer device.

The device of the invention is incorporated in a flatwork ironer such as described in FIGS. 1 to 4. In the description which follows, the same elements are designated by the same reference numbers as previously.

In order to avoid bending the corner zones arranged in the upper part of the piece of fabric, a deflector 33 is mounted on the clamp 8 and a symmetrical deflector is mounted on clamp 10. These defectors permit suppressing the application of blowing from tube 28 on the zones near the corners of the piece of fabric. These deflectors 33 and 34 are mounted on we clamps 8 and 10 or on the trolleys supporting these. One thus avoids applying blowing in the zones of the article close to the corners whatever the size of the piece being transferred.

The device represented in the drawing has a smoothing system 29 exerting an underpressure on the fabric when this is placed in the vertical space of the transfer device. The falling piece is removed from the smoothing system 29 by a spacing apparatus 30. This spacing apparatus is, in the embodiment represented in the drawings, comprised by a tube 30 closed at its extremities but having orifices oriented in the direction in which the piece should be attracted. The tube has a supply of compressed air. The scattering action of the smoothing system 29 is obtained by injecting, for the time necessary for this removal, compressed air into the tube 30. It is a matter of action by the Venturi effect. The orientation and the speed of the jet of air create an underpressure which acts on the piece and attracts it in the direction opposite to the smoothing system 29. The Venturi effect is reinforced by the presence of a wall 32 serving as a deflector which orients which orients the air downward and thereby avoids disturbing the pieces of fabric situated downstream in the cycle of functioning of the machine.

The invention claimed is:

1. Transfer device for an industrial flatwork ironer used to stretch flat square or rectangular pieces of textile for subsequent processing, between a conveyor supplying the pieces and a second conveyor on which the pieces are spread, the transfer device comprising:

a vertical passageway between the supply conveyor and the second conveyor in which each piece is successively brought into vertical position and grasped by two corners of said piece situated downstream;

two clamps movable on a beam oriented transversally toward the conveyors;

a blowing ramp situated on one side of the supply conveyor in relation to the vertical plane in which the piece of fabric is situated, nozzles of which are oriented toward the second conveyor;

an apparatus for grasping the piece outfitted with an aspiration apparatus situated on a side of the conveyors between an advanced position of taking the piece of textile and a retracted position of depositing the piece on the second conveyor;

a fixed abutment opposite the apparatus for grasping the piece, situated on a same side of the vertical plane as the supply conveyor, against which the grasping apparatus is supported during opening phases of the clamps and of transfer of an upper extremity of the piece on the grasping device.

2. Device according to claim 1, wherein the fixed abutment is covered by a band of elastic material in a zone of support of the grasping apparatus.

3. Device according to claim 1, wherein each clamp of a corner of the piece of textile, or a support of each clamp, comprises a deflector designed to deflect a flow of air blown by the nozzle of a ramp arranged in zones of the piece near the corners thereof in order to prevent these zones from being subjected to a flow of air under pressure.

4. Device according to claim 1, further comprising a smoothing system arranged below the second conveyor which exerts an under-pressure and includes an apparatus designed to prevent the pieces coming from the supply conveyor arriving in the vertical passageway from being aspirated into the smoothing system.

5. Device according to claim 4, further comprising a tube fed by compressed air situated on a same side of the vertical passageway as the supply conveyor and facing an entrance of the smoothing system having orifices arranged radially over a length of the tube and opening on a side opposite to the smoothing system.

6. Device according to claim 5, further comprising a fixed wall forming a deflector arranged opposite the orifices arranged in the tube.

* * * * *